United States Patent [19]

Appling et al.

[11] Patent Number: 4,634,102

[45] Date of Patent: Jan. 6, 1987

[54] SELF-THREADING CAPSTAN DRIVE

[76] Inventors: James Appling, 6917 Bobbyboyer Ave., Canoga Park, Calif. 91307; John M. Franchuk, 3806 191st Pl. SW., Lynnwood, Wash. 98036

[21] Appl. No.: 812,588

[22] Filed: Dec. 23, 1985

[51] Int. Cl.[4] ..... B66D 1/26; B66D 1/34

[52] U.S. Cl. ..... 254/278; 242/155 BW; 254/333; 254/371; 254/383; 254/389

[58] Field of Search ..... 254/278, 279, 280, 283, 254/286, 325, 327, 333, 334, 338, 371, 383, 294, 389; 242/54 A, 155 BW, 47.08

[56] References Cited

U.S. PATENT DOCUMENTS

| | | | |
|---|---|---|---|
| 1,750,826 | 3/1930 | Watson | 254/414 |
| 3,729,173 | 4/1973 | Levardon | 254/333 |
| 3,887,164 | 6/1975 | Coombs | 254/333 X |

FOREIGN PATENT DOCUMENTS

| | | | |
|---|---|---|---|
| 3138034 | 4/1983 | Fed. Rep. of Germany | 254/278 |
| 1367078 | 9/1974 | United Kingdom | 254/280 |
| 143531 | 4/1961 | U.S.S.R. | 254/333 |

*Primary Examiner*—Stuart S. Levy
*Assistant Examiner*—Joseph J. Hail, III

[57] ABSTRACT

A self-threading capstan drive includes two sheaves mounted in a frame, each having a spiral groove with approximately three turns. The sheaves are slightly misaligned so that an elongated sonar array is directed from one sheave to the next without lateral bending. A pair of containment troughs are aligned with the top and bottoms of the sheaves to direct the sonar array between the sheaves. At least one of the sheaves is motor-driven such that its direction of rotation is reversible, the sonar array being reeled onto and off of a storage reel. Each of the sheaves and the containment troughs includes a groove with an inner channel whose dimensions accommodate the sonar array and an outer channel of larger diameter accommodating an endless tubular belt which recirculates over both sheaves and makes contact throughout most of its length with the sonar array, positively driving and carrying the sonar array in either direction.

12 Claims, 5 Drawing Figures

FIG. 2
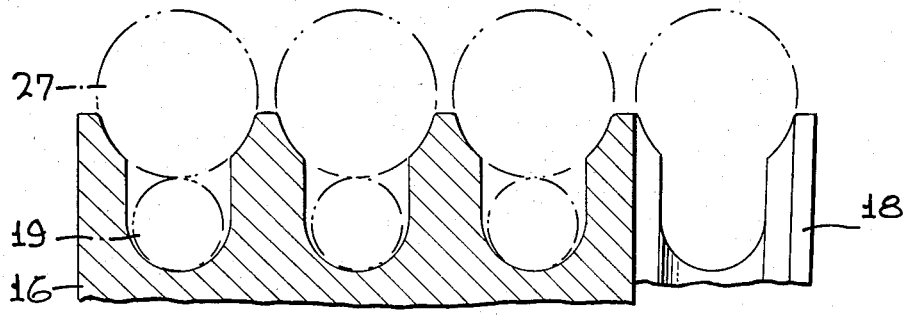
FIG. 3
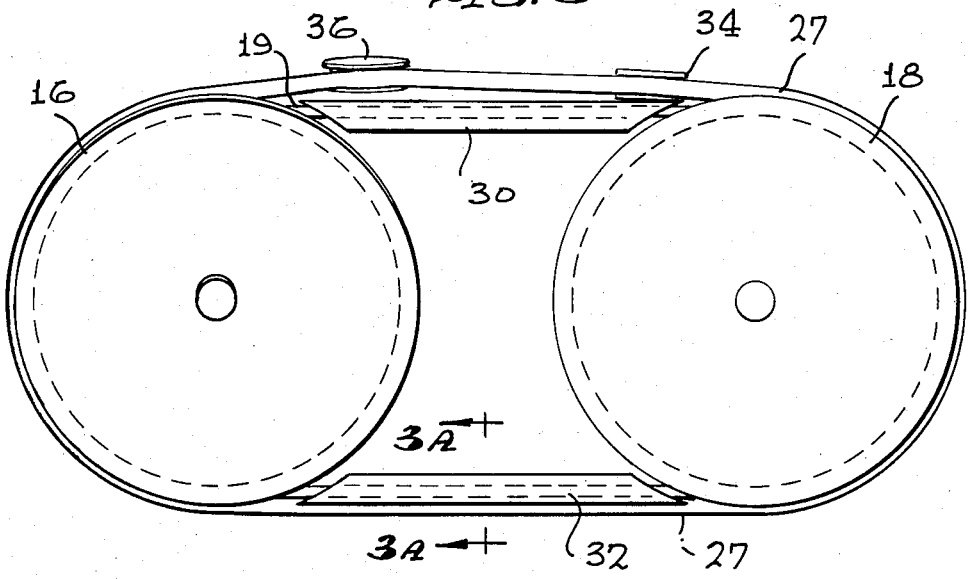
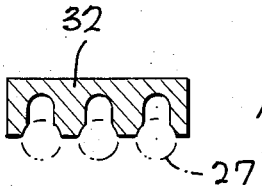
FIG. 3A
FIG. 4
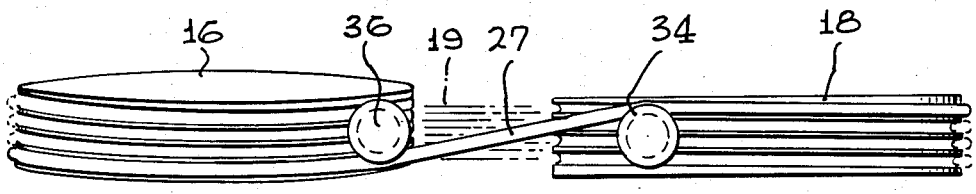

SELF-THREADING CAPSTAN DRIVE

This invention relates to a self-threading capstan drive.

A capstan normally includes one or two grooved sheaves carried on or in a frame, motor means for driving at least one of the sheaves and, where two sheaves are used, means for guiding a cable or rope from one sheave to the other.

Self-threading capstans are known and usually include a plurality of pinch rollers adjacent the lead groove of the entry sheave which capture the cable or rope and feed it into the capstan. They are particularly useful in connection with certain towed sonar arrays. Such arrays are carried on a ship or submarine and include a length of acoustically transparent hose containing an acoustic array with hydrophones, electronic modules and interconnecting wires, a vibration isolation module attached to the array which is very stretchy and which absorbs vibration from the towing vessel, and a tow cable which is attached to the vibration isolation module. The opposite end of the tow cable is attached to a reel in the towing vessel and is of such length that the acoustic array will trail behind the towing vessel a sufficient distance that it is not significantly affected by the wake of the vessel. The loading on the capstan varies from very little as the array is initially reeled out to very high when it is desired to reel in several thousand feet of cable, vibration isolation module, and acoustic array. Normally the sheaves are misaligned somewhat to compensate for the angularity of the grooves so that the cable, array, etc. can pass smoothly from one sheave to the other.

In one application where the array is towed by a submarine, the reel and capstan are carried in a ballast tank and are quite inaccessible for normal servicing. The self-threading feature becomes almost essential in this situation since the reel and capstan can only be serviced in drydock or by a diver working underwater. One design of self-threading capstan drive which exists uses a plurality of pinch rollers to guide the array into the lead groove of the capstan. It also uses twisted belts or bands having fingers as guides to direct the array from one sheave to the other. This arrangement usually is satisfactory in deployment, but on reeling the array in under substantial load, the fingers and belts tend to abraid the plastic hose covering the hydrophones and, in addition, they stretch the vibration isolation module badly out of shape. This points up a need for a self-threading capstan drive which will deploy and recover the described array, vibration isolation module and tow cable without injury to or deterioration of the array. Such a capstan drive needs also to be reliable in operation such that it will not need servicing within the normal periods between drydocking of the submarine.

The capstan drive of the invention is characterized in that it includes two sheaves and the grooves in the sheaves include a deep inner channel sized to accommodate the tow cable, the vibration isolation module, and the acoustic array and a larger diameter upper or outer channel which receives an endless tubular belt of significantly greater diameter than the sonar array. This endless belt winds continuously from the first sheave to the second and back again, carrying with it the sonar array. From the time the array reaches the lead groove (in either direction) it is captured between the lead groove in the sheave and the endless tubular belt and is carried through the capstan. The endless tubular belt thus effectively directs the array from a groove on one sheave to the lead groove on the other so that the array does not become tangled or miss the lead groove. Since the tubular belt has no fingers or scraping members to abraid the surfaces of the acoustic array or the vibration isolation module, they are not significantly deteriorated from reeling in or out through the capstan drive.

In the drawings:

FIG. 2 is a fragmentary view, partly in section, of a pair of capstan sheaves according to our invention;

FIG. 3 is a schematic side view of the capstan assembly of FIG. 1 with the frame structure removed;

FIG. 3A is a sectional view taken along line 3A—3A of FIG. 3.

FIG. 4 is a schematic plan view of the capstan assembly of FIG. 1 with the frame structure removed.

Figure 1:
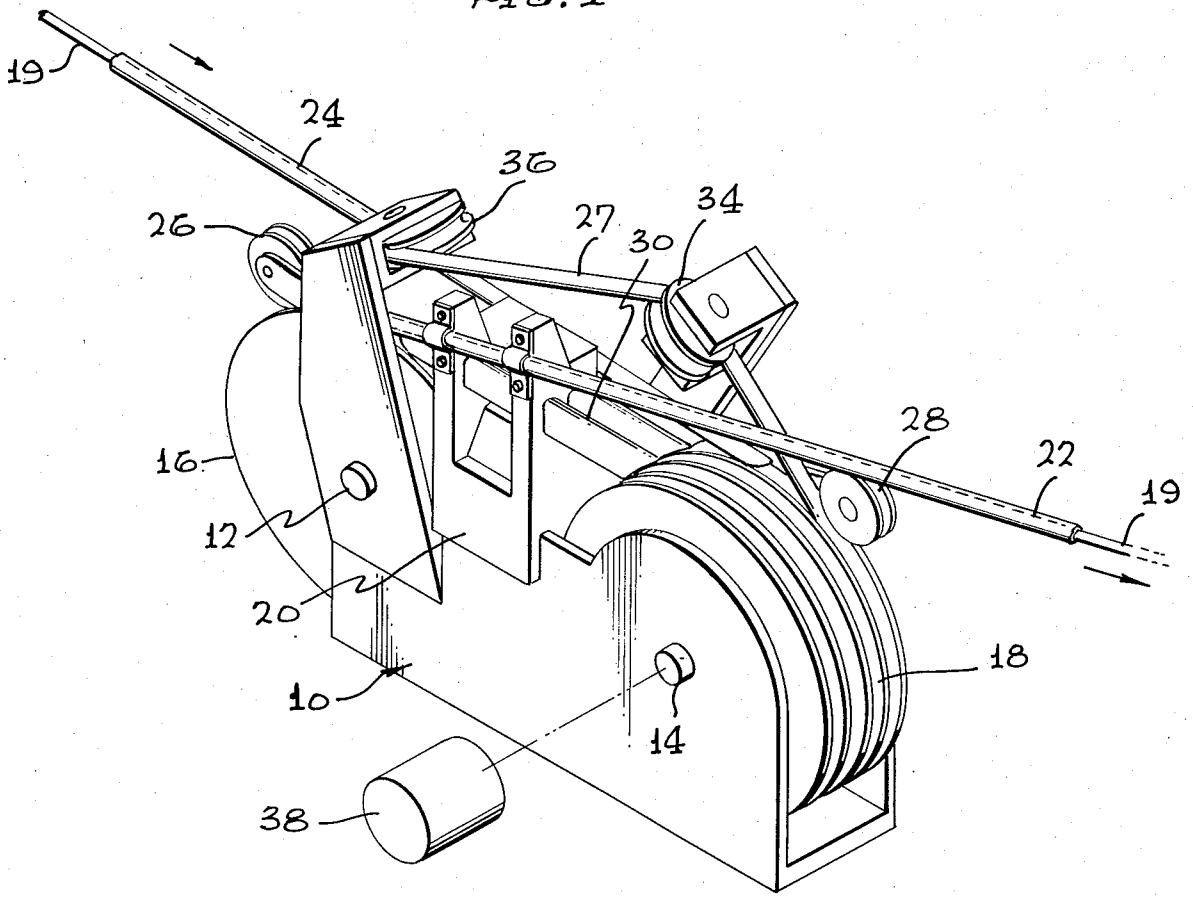
FIG. 1 is a perspective view of a capstan assembly according to our invention.

Referring now to FIG. 1, the capstan assembly includes a frame 10 which is preferably of strong metal such as steel and which supports a pair of axle shafts 12 and 14 carrying sheaves 16 and 18, respectively. Each of sheaves 16 and 18 includes a spiral groove which makes approximately three circumferences or wraps of the sheaves. Because these grooves are spiral they have an angularity with respect to the planes of rotation of the sheaves. So that the array will pass smoothly from one sheave to the other, the sheaves are offset by a small angle, the amount of which will vary with the geometry of the assembly such as the diameter and width of the sheaves and the diameter of the array, etc., as shown in FIG. 2. In this figure are shown partial end views of sheaves 16 (in section) and 18 with sheave 18 offset somewhat from direct alignment with sheave 16.

Attached to the frame 10 is a bracket 20 which carries a tubular guide member 22 which directs the array into the capstan assembly and a second tubular guide member 24 which guides the array toward and from a storage reel, not shown. A pinch roller 26 is carried on bracket 20 which tends to direct the endless belt 27 into the lead groove of sheave 16. Cooperating with guide member 24 is a second pinch roller 28 which guides the endless belt 27 into the groove of sheave 18. Supported on bracket 20 is a containment trough 30 (FIG. 3) which receives the array from the top side of one sheave and directs it to a corresponding groove on the top side of the opposite sheave. A similar containment trough 32 is carried in frame 20 (not shown in this view) which directs the array from the bottom of one sheave to the bottom of the other. Section 3A—3A of FIG. 3 is a cross-sectional view of trough 32. Trough 30 is essentially the same as trough 32 except that the grooves face upwardly, of course. Also shown in FIG. 3 are a pair of guide pulley wheels 34 and 36 which serve to direct the endless belt 27 to cross over from one sheave to the other. A plan view of this crossover pattern is shown in FIG. 4 in which endless belt 27 is carried from one end of a spiral groove on sheave 16 to one side of a guide pulley 36, passing partially around guide pulley 36 and diagonally across the width of the spiral grooves to pass around pulley 34 and into a groove on the opposite edge of sheave 18. The endless belt 27 then follows the spiral pathway from one sheave to the other until it again reaches the crossover pulleys.

As stated above, the storage reel (not shown) and the capstan drive 10 may be located in an inaccessible chamber such as a ballast tank. The acoustic array, being the trailing part of the entire sonar array, will feed first from the reel and will pass from guide 24 into the capstan drive where it is directed into a groove of sheave 18 and is captured under the endless belt 27, and carried through the spiral pathway formed by the sheaves 18 and 16 and containment troughs 30 and 32, exiting through guide tube 22. Following the acoustic array, the vibration isolation module and then the tow cable pass through the capstan drive in the same way. Upon retrieval, the capstan drive is reversed, winding in the tow cable, the vibration isolation module and the sonar array. The drive motor 38 for the capstan may be placed wherever convenient. It must be reversible or incorporate means for reversing the drive direction. The motor could be placed inside of one of the sheaves 16 or 18, or arranged to drive one of axles 12 or 14 from outside of frame 10, as shown. The diameter of the sheaves must be sufficient that the hydrophones and electronic modules in the array are not subjected to undue bending forces when the array is wrapped around the sheaves.

We claim:

1. A self-threading capstan drive including a frame, first and second sheaves having multi-layer grooves rotatably supported in said frame, motor means for driving at least one of said sheaves, and guide means for directing an elongated tubular member into and out of said capstan drive, said sheaves being slightly misaligned from each other to aid in directing said elongated tubular member from one sheave to the other, characterized in that the grooves in each of said sheaves include a deep channel of size to accommodate said tubular member and a larger diameter upper channel, an endless tubular belt of significantly greater diameter than said elongated tubular member, said belt being carried in said upper channel of the grooves in said sheaves such that when said elongated tubular member is fed into the inlet guide means said tubular member is captured between the sides of said deep channel and said tubular belt and is carried by said tubular belt around the pathway formed by said sheaves and from one sheave to the other.

2. A self-threading capstan drive as claimed in claim 1 wherein said frame carries a plurality of small guide pulleys for directing said endless tubular belt from a groove on one side of said first sheave to a groove on the opposite side of said second sheave.

3. A self-threading capstan drive as claimed in claim 1 wherein a pinch roller is employed to hold said endless tubular belt against at least one of said sheaves.

4. A self-threading capstan drive as claimed in claim 1 wherein each of said first and second sheaves includes a spiral groove with approximately three wraps.

5. A self-threading capstan drive as claimed in claim 1 wherein a containment trough is positioned between said sheaves to direct said elongated tubular member and said tubular belt from one sheave to the other, said containment trough having grooves with a deep channel to accommodate said array and a larger diameter upper channel to receive and direct said endless tubular belt.

6. A self-threading capstan drive as claimed in claim 5 where a containment trough is positioned adjacent both the top and bottom edges of said sheaves to direct said sonar array and said endless tubular belt.

7. A self-threading capstan drive including a frame, first and second sheaves supported in said frame, means for driving at least one of said sheaves, guide means for directing an elongated tubular sonar array into and out of said capstan drive, characterized in that the grooves in said sheaves include a deep channel to accommodate said sonar array and a larger diameter outside channel, and an endless tubular belt of significantly greater diameter than said sonar array, said belt being carried in said outside channel of the grooves in said sheaves such that when said sonar array is carried on said sheaves said belt makes contact throughout much of its length with said array and carries said array around the grooves of said sheaves and from sheave to sheave.

8. A self-threading capstan drive as claimed in claim 7 wherein each of said first and second sheaves includes a spiral groove with approximately three wraps.

9. A self-threading capstan drive as claimed in claim 7 wherein a containment trough is positioned between said sheaves to direct said elongated tubular member and said endless tubular belt from one sheave to the other, said containment trough having grooves with a deep channel to accommodate said array and a larger diameter upper channel to receive and direct said endless tubular belt.

10. A self-threading capstan drive as claimed in claim 9 where a containment trough is positioned adjacent both and top and bottom edges of said sheaves to direct said sonar array and said endless tubular belt.

11. A self-threading capstan drive as claimed in claim 7 wherein guide tubes are provided to direct said sonar array into and away from said grooves on said sheaves.

12. A self-threading capstan drive as claimed in claim 7 wherein said first and second sheaves are slightly offset because of the spiral angle of the grooves so that said sonar array can be smoothly directed from one sheave to the next.

* * * * *